United States Patent [19]

Roccaforte

[11] Patent Number: 4,511,043

[45] Date of Patent: Apr. 16, 1985

[54] EASY OPENING CARTON

[75] Inventor: Harry I. Roccaforte, Western Springs, Ill.

[73] Assignee: Champion International Corporation, Stamford, Conn.

[21] Appl. No.: 533,214

[22] Filed: Sep. 19, 1983

[51] Int. Cl.[3] ..... B65D 5/72

[52] U.S. Cl. ..... 206/620; 206/634; 229/17 R

[58] Field of Search ..... 206/620, 634, 629, 633, 206/601, 608, 609, 617, 1; 229/17 R, 7 R, 3.5 R

[56] References Cited

U.S. PATENT DOCUMENTS

| | | | |
|---|---|---|---|
| 2,321,655 | 6/1943 | Carr | 229/17 R |
| 2,680,558 | 6/1954 | Mai | 206/629 X |
| 2,844,297 | 7/1958 | Holmes | 206/633 X |
| 2,953,293 | 9/1960 | Anderson | 206/634 X |
| 3,104,793 | 9/1963 | Hickin | 229/17 R |
| 3,404,988 | 10/1968 | Ransing | 206/634 X |
| 3,958,748 | 5/1976 | Smith et al. | 206/629 X |
| 4,429,828 | 2/1984 | Färber | 206/634 X |

*Primary Examiner*—Allan N. Shoap
*Assistant Examiner*—Bryon Gehman
*Attorney, Agent, or Firm*—Evelyn M. Sommer; John H. Mulholland; William W. Jones

[57] ABSTRACT

An easy opening carton and blank for forming same made from a paperboard material comprising a laminate of a smooth cover sheet and an inner lining, or a unitary construction are provided. The generally rectangular carton has opposed front and back walls, opposed side walls and opposed top and bottom walls. A parallel array of perforation lines are disposed on one side wall adjacent the top wall in a configuration such as a V or a semi-circle to form an easy opening area. The parallel array of perforations includes a plurality of parallel lines of perforations having each perforation in alternating positions between adjacent lines of perforations. The parallel array of perforations defines a wide area of penetration which sufficiently weakens the inner paperboard lining to facilitate opening the carton. Inward pressure on the easy opening area will separate the area from the side walls and permit the top wall to be torn back to form a pour spout.

16 Claims, 9 Drawing Figures

EASY OPENING CARTON

BACKGROUND OF THE INVENTION

Cardboard containers with pour spouts that require the consumer to push in a section of one side wall and tear back the top wall of the carton have heretofore been constructed of a single line of perforations defining the pour spout. In many instances, the single line of perforations in the prior art containers may not sufficiently weaken the inner lining of the cardboard side wall thereby making it relatively difficult for the consumer to break the lining. Consequently, the consumer may be forced to resort to a knife or other utensil to open the container, thus defeating the purpose of the perforations. Additionally, even if the consumer is able to break the inner lining of the container by pushing on the single line of perforations, often the break will be an imperfect tearing of the side wall linings which may result in an inferior pour spout. The particles inside the container may become caught between the linings and it can be difficult to control the pouring of the particles.

An improvement in the prior art paperboard containers with pour spouts is shown in U.S. Pat. No. 3,981,430 issued to Keim. More particularly, U.S. Pat. No. 3,981,430 discloses a tab defined by a single line of perforations in a side wall of the container adjacent to the top wall. The walls of the container are further provided with arcuate fold lines that enable an enlarged pouring spout to be formed. However, the linings of the paperboard container must be broken and the consumer may still have to resort to extraneous materials to open the container if the single perforated line has not sufficiently weakened the side wall.

Other types of pour spout arrangements are disclosed in U.S. Pat. Nos. 3,618,847 issued to Koolnis; 3,570,745 issued to Aoki; and 3,262,630 issued to Koolnis. These all disclose an extra tab in the outside of the side wall to facilitate opening the carton and a single line of perforations along the edges of the top wall. The principal deficiency with this type of poor spout is that the tab may not be strong enough to break the single perforated lines on the top walls. Furthermore, the extra material required to provide the tab adds to the expense of manufacturing the carton.

U.S. Pat. No. 4,142,635 issued to Capo et al. discloses a pour spout formed by an extra tab of material in the inside layer of the top wall defined by a single line of perforations. The extra tab is adhesively secured to the outer layer of the container which also includes a tab defined by a single line of perforations. Thus, to open the carton shown in U.S. Pat. No. 4,142,635 the consumer must separate two distinct sets of single perforated lines which would probably require the use of a utensil.

U.S. Pat. No. 3,133,689 which issued to Rossi relates to a carton which includes an inner tab of material defined by a single line of perforations in the side wall. An outer tab is merely a layer of material adhesively secured to the inner tab lying outside the side wall. If the adhesive bond is not secure enough it may not be sufficient to separate the inner tab from the single line of perforations. Thus, the consumer would be forced to open the carton with an implement, such as a knife.

Accordingly, it is an object of the subject invention to provide an easy opening carton with an integral pour spout that can be opened without the use of extraneous utensils.

It is another object of the subject invention to provide an easy opening carton with an integral pour spout which permits the inner lining of the carton to be broken cleanly to facilitate pouring of the contents from the carton.

It is a further object of the subject invention to provide an easy opening carton with an integral pour spout that can be inexpensively manufactured from a single blank of paperboard material.

It is an additional object of the subject invention to provide an easy opening carton with an integral pour spout defined by a plurality of parallel lines of perforations.

It is yet another object of the subject invention to provide a single blank of paperboard material that can be formed into an easy opening carton with an integral pour spout.

SUMMARY OF THE INVENTION

The subject invention provides an easy opening carton with a pour spout and a blank for forming the carton made from a single sheet of paperboard material. The paperboard is generally a laminate of a smooth cover sheet on which is provided printing and an inner liner material, but may also be of unitary construction. The subject blank consists of consecutively articulated rectangular glue flap, back panel, first side panel, front panel and second side panel separated by folded lines. Back end flaps and front end flaps are articulated to the opposed top and bottom ends of the back panel and front panel, respectively. Similarly, dust flaps are articulated to the opposed top and bottom ends of the first side panel and second side panel, respectively. A plurality of perforated lines are disposed in a spaced parallel array on the first side panel adjacent to the top edge thereof. The plurality of perforated lines are generally in the shape of a V pointing from the top edge to the bottom edge of the side panel. The parallel array may be in many shapes including arcuate. The individual perforations of each adjacent perforated line are alternately offset along the horizontal axis of the parallel array. The perforations penetrate through the cover sheet and substantially into the inner lining. The plurality of perforated lines operates to penetrate and weaken a wider area of the inner lining than would a single perforation line. Thus, the inner lining is more easily broken by applying pressure along the plurality of perforated lines.

The erected carton of the subject invention includes a front wall, back wall, first side wall and second side wall formed from the front, back, first side and second side panels, respectively. The top and bottom walls are formed by the dust flaps and the back end and front end flaps. An easy opening area is defined intermediate the plurality of perforated lines and the top end of the first side wall. The carton is opened by applying pressure to the easy opening area in the first side wall to break the inner lining of the carton. The amount of pressure applied will be the minimum required to release the easy opening area from the remaining portion of the first side wall below the plurality of perforated lines. The top wall is then torn back toward the second side wall as desired to form a pour spout from which the contents of the carton may be easily dispensed.

DETAILED DESCRIPTION OF THE PREFERRED EMBODIMENT

Figure 1:
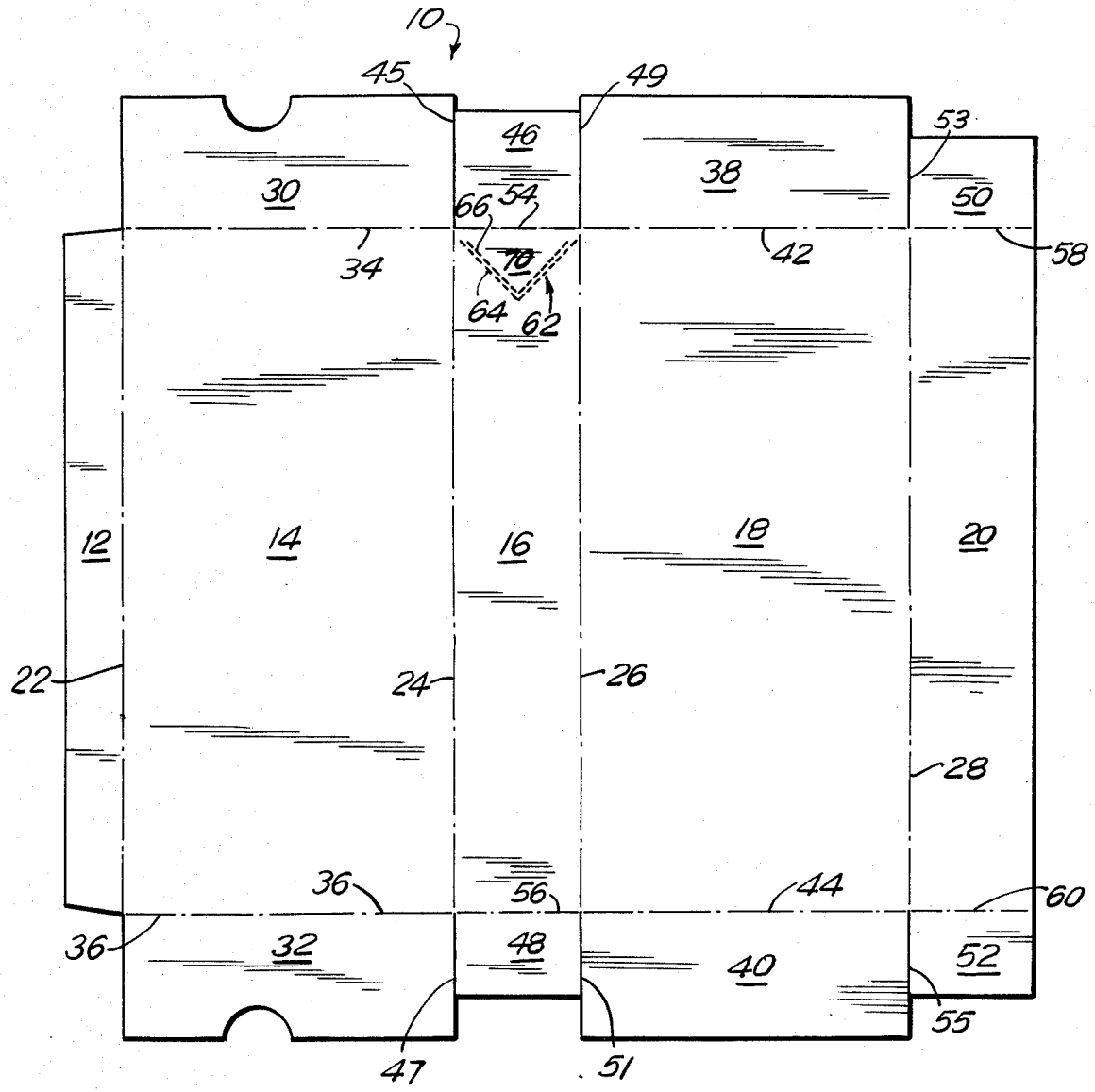
FIG. 1 is a plan view of the blank made according to the subject invention.

The blank according to the subject invention is indicated by the number 10. Blank 10 has, consecutively articulated, rectangular glue flap 12, back panel 14, first side panel 16, front panel 18, and second side panel 20 separated by fold lines 22, 24, 26 and 28 respectively. Back end flaps 30 and 32 are foldably connected to back panel 14 along fold lines 34 and 36 respectively. Similarly, front end flaps 38 and 40 are foldably connected to front panel 18 along fold lines 42 and 44 respectively. Dust flaps 46, 48, 50, and 52 are foldably connected to the first side panel 16 and second side panel 20 along fold line 54, 56 and 58, 60 respectively. Dust flaps 46 and 48 are separated from back end flaps 30, 32 and front end flaps 38, 40 by cut lines 45, 47, 49, 51 respectively. Dust flaps 50 and 52 are separated from front end flaps 38 and 40 by cut lines 53 and 55 respectively.

A parallel array of perforations 62 are provided in first side panel 16 adjacent fold line 54. The parallel array of perforations 62 as shown in FIG. 1 is in the form of a V, consisting of two spaced, parallel lines of perforations 64 and 66. The individual perforations in each line of perforations are alternately offset from the perforations in each adjacent line of perforations along the longitudinal areas of the parallel array 62.

The parallel array of perforations 62 is provided in the first side panel 16, with the apex of the V pointing toward fold line 56 of first side panel 16. Thus, fold line 54 and the parallel lines of perforations define an easy opening area 70 for opening the carton according to the subject invention.

Figure 2:
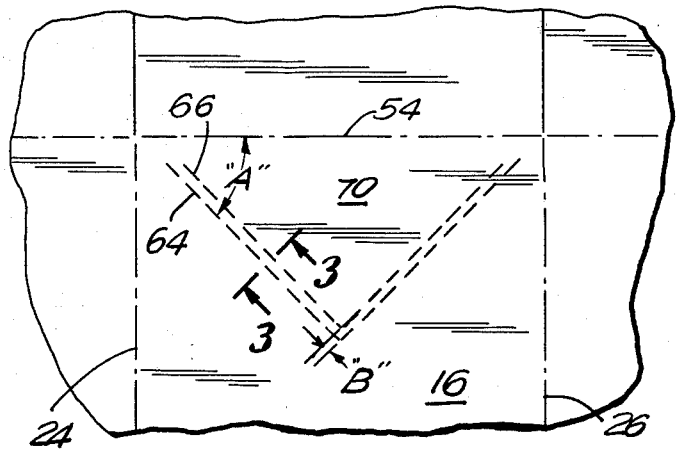
FIG. 2 is an enlarged section of the blank according to the subject invention showing the V shaped easy opening area.
Figure 3:
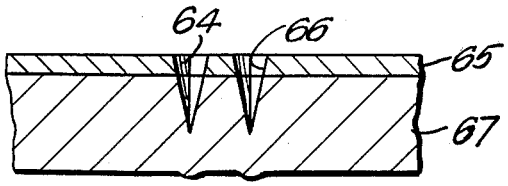
FIG. 3 is a cross-sectional view of the blank taken along line 3—3 in FIG. 2 showing two parallel perforations extending into a laminate paperboard carton according to the subject invention.
Figure 4:
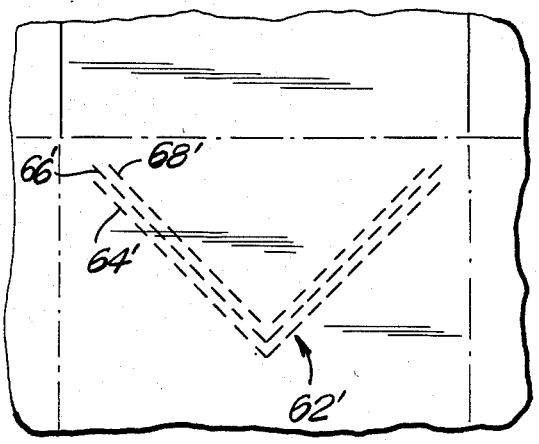
FIG. 4 is an enlarged section of the blank according to the subject invention showing a V shaped easy opening area defined by three parallel lines of perforations.
Figure 5:
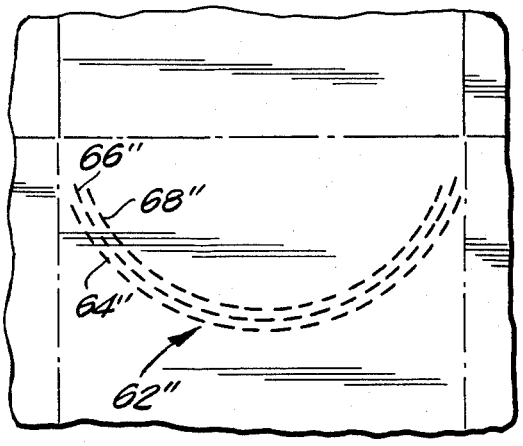
FIG. 5 is an enlarged section of another embodiment of the blank according to the subject invention showing a half-circle shaped easy opening area.
Figure 9:
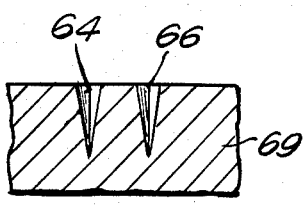
FIG. 9 is a cross-sectional view of the blank taken along line 3—3 in FIG. 2 showing two parallel perforations extending into a unitary paperboard carton according to the subject invention.
Figure 8:
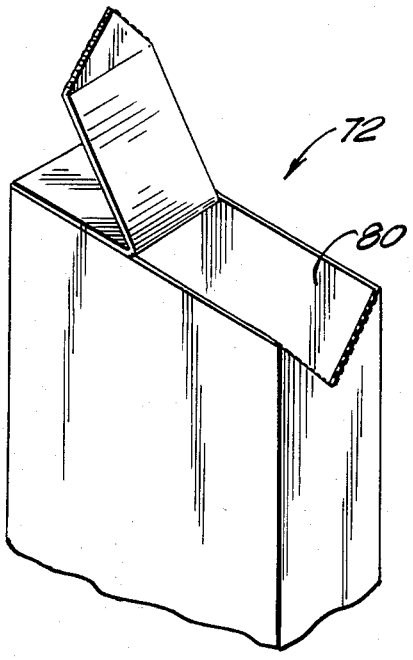
FIG. 8 is a perspective view of the erected carton according to the subject invention showing the carton entirely opened.

The angle between fold line 54 and the parallel lines of perforations is indicated by the letter "A" in FIG. 2 and is preferably 45°. The parallel lines of perforations provide a wide area of penetration into the paperboard lining to facilitate opening the carton. However, to achieve this effect the lines of perforations cannot be spaced too far apart. Therefore, it is preferred that the distance "B" as shown in FIG. 2 between the lines of perforations be 1/32 of an inch. FIG. 3 shows a cross-sectional view of the parallel lines of perforations 64, 66 taken along line 3—3. The cross-sectional view in FIG. 3 also shows that the blank 10 is a laminate of a smooth cover sheet 65 and inner lining material 67. However, blank 10 may also be made of a unitary paperboard material 69, as shown in FIG. 9. As can be seen in FIG. 3, the two parallel lines of perforations 64, 66 weakens a wide area of the inner lining material 67 to make breaking of the inner liner easier. In addition, to provide sufficient weakness in the paperboard lining the perforations should preferably penetrate the paperboard lining of the panel between 50% to 80% of its total thickness. FIG. 3 shows a detailed view of perforation lines 64, 66 which have a thickness penetration of approximately 70%. In order to provide an even wider area of penetration, more than two parallel lines of perforations may be used. FIG. 4 shows the configuration of parallel array 62' which includes three lines of perforations 64', 66' and 68' in the shape of a V. In addition, it should be appreciated that the shape of the parallel array of perforations is not critical and many different shapes may be used to attain the desired results. For example, a semi-circular array 62" of perforations may be provided as shown in FIG. 5. In FIG. 5, the three parallel lines of perforations are indicated by the numerals 64", 66" and 68".

Figure 6:
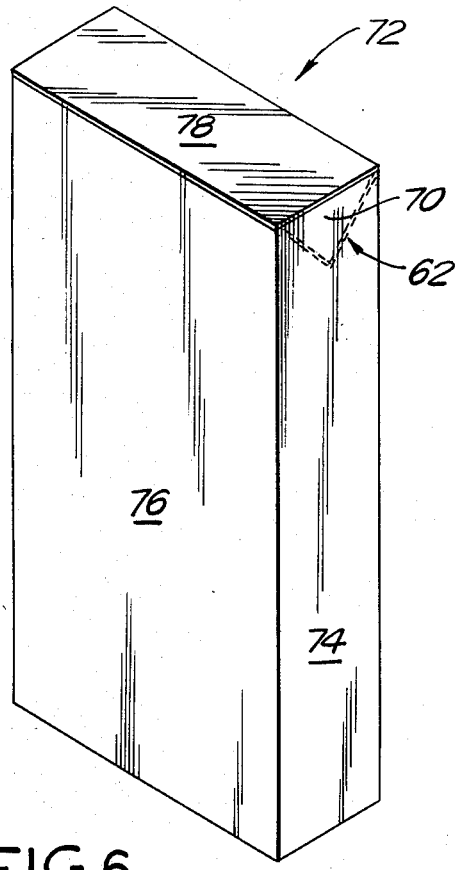
FIG. 6 is a perspective view of the erected carton according to the subject invention showing the easy opening area prior to opening.
Figure 7:
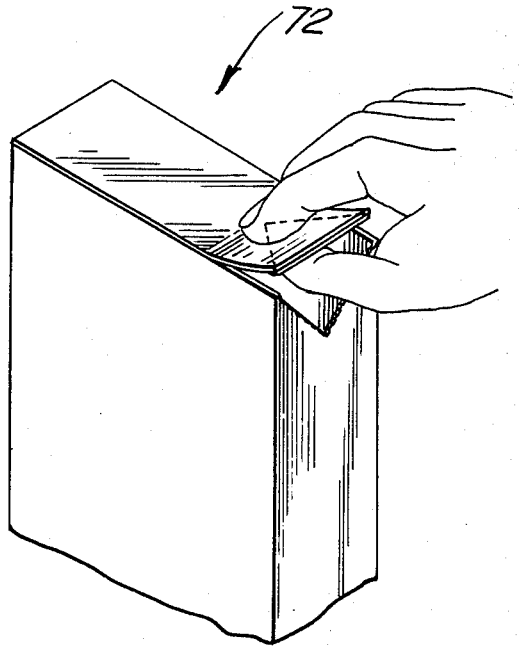
FIG. 7 is a perspective view of the erected carton according to the subject invention showing the easy opening area partially opened.

The easy opening carton 72, as erected, is shown in FIG. 6. The carton 72 has first side wall 74 formed from first side panel 16 of blank 10. Back wall 76 is formed from back panel 14 of blank 10. Additionally, top wall 78 is formed from dust flaps 46, 50, back end flap 30, and front end flap 38 of blank 10. To open carton 72, as shown in FIG. 7, a minimum of pressure is applied to the easy opening area 70 inwardly of the carton to easily break the lining of the paperboard. The top wall 78 can then be easily torn back to any desired distance depending on the contents of the carton. Thus, an excellent pour spout 80, integral with the carton 72, is easily formed without the need for knives or other utensils.

In summary, an easy opening carton and blank for forming same made from a paperboard laminate of a smooth outer layer and an inner lining or a unitary construction are provided. The blank includes a glue flap, back panel, first side panel, front panel and second side panel, all of which are rectangular in configuration and consecutively articulated along fold lines. Back end and front end flaps are articulated to the opposed ends of the back and front panels respectively. Similarly, dust flaps are articulated to the opposed ends of the first and second side panels. A parallel array of perforations are disposed on the first side panel adjacent the top edge thereof and are preferably V-shaped in configuration. The parallel array of perforations may be in other forms such as semi-circular. The array of perforations includes two or more parallel lines of perforations, with the perforations in each line being in alternate positions from the perforations in each adjacent line, as shown in FIG. 2. The parallel lines of perforations are positioned relatively close to each other to form an easy opening area defined by a wide area of penetration which will facilitate breaking the inner lining of the carton. Once the carton is erected the easy opening area is separated from the remaining portion of the first side panel and the top wall of the carton is torn back to form a convenient pour spout.

While a preferred embodiment of the subject invention has been described and illustrated, it is obvious that various changes and modifications can be made therein without departing from the spirit of the present invention which should be limited only by the scope of the appended claims.

What is claimed is:

1. A generally rectangular easy opening carton made from a single sheet of paperboard material, said carton comprising:

opposed rectangular front and back walls, opposed rectangular first and second side walls, said first and second side walls being perpendicular to and extending between said front and back walls, and opposed rectangular top and bottom walls, said top and bottom walls being perpendicular to and extending between said front, back and first and second side walls;

said top and bottom walls including opposed dust flaps articulated to each said first and second side walls, a back end flap articulated to said back wall and a front end flap articulated to said front wall; and said first side wall being of a single thickness of paperboard material and including a spaced parallel array of perforation lines, each perforation in each line of perforations being alternately offset from each perforation in each adjacent and parallel line of perforations along the longitudinal axis of said parallel array of perforation lines thereby weakening a wide area of said paperboard material, the perforations of said perforation lines extending into the paperboard material from the same exterior surface of the paperboard material said parallel array of perforation lines being adjacent said top wall and extending toward said bottom wall thereby defining means including an easy opening area whereby when the easy opening area is pressed inwardly in said carton the wide weakened area permits the paperboard material to be easily broken thereby separating the easy opening area from said first side wall along the parallel array of perforation lines thus allowing said top wall and adjacent dust flap to be torn back to easily open said carton.

2. An easy opening carton as in claim 1 wherein the parallel array of perforation lines being in the form of a V.

3. An easy opening carton as in claim 1 wherein the parallel array of perforation lines being in an arcuate configuration.

4. An easy opening carton as in claim 1 wherein the parallel array of perforation lines consists of two parallel lines of perforations.

5. An easy opening carton as in claim 1 wherein the parallel array of perforation lines consist of three parallel lines of perforations.

6. An easy opening carton as in claim 1 wherein the perforations penetrate from between 50% to 80% into the first side wall.

7. An easy opening carton as in claim 1 wherein the parallel lines of perforations are separated by 1/32 of an inch.

8. An easy opening carton as in claim 1 wherein the paperboard material comprises a laminate of a smooth cover sheet and an inner lining, whereby said parallel lines of perforations weaken a wide area of said inner lining to permit said inner lining to be easily broken.

9. A paperboard blank for forming an easy opening carton, said blank comprising:

generally rectangular and consecutively articulated glue flap, back panel, first side panel, front panel and second side panel separated by fold lines of substantially equal length, each of said panels including a pair of opposed top and bottom ends;

a back end flap, first dust flap, front end flap and second dust flap articulated respectively to the opposed ends of said back panel, first side panel, front panel and second side panel, which form the top and bottom walls respectively when the carton according to the subject invention is erected, said first and second dust flaps being separated from each said front and back panels by a cut line perpendicular to the opposed ends of said front and back panels; and said first side panel including a plurality of spaced parallel lines of perforations, each perforation of each parallel line of perforations being in an alternate position from each perforation in each adjacent parallel line of perforations thereby weakening a wide area of said paperboard material, the perforations of said perforation lines extending into the paperboard material from the same exterior surface of the paperboard material said plurality of parallel lines of perforations being adjacent the top end of said first side panel and generally extending toward the bottom end of said first side panel thereby defining means including an easy opening area whereby when the carton is erected and the easy opening area is pressed inwardly in said carton the wide weakened area permits the paperboard material to be easily broken thereby separating the easy opening area from said first side panel along the plurality of parallel lines of perforations thus allowing said top wall to be torn back to easily open said carton.

10. A blank as in claim 9 wherein the plurality of parallel lines of perforations is substantially in the form of a V.

11. A blank as in claim 10 wherein the angle between the top end of said first side panel and the legs of the V of the plurality of parallel lines of perforations is substantially 45°.

12. A blank as in claim 9 wherein the plurality of parallel lines of perforations is substantially in the form of half-circle.

13. A blank as in claim 9 wherein the parallel lines of perforations include two parallel lines.

14. A blank as in claim 9 wherein the plurality of parallel lines of perforations include three parallel lines.

15. A blank as in claim 9 wherein the parallel lines of perforations are separated by 1/32 of an inch.

16. A blank as in claim 9 wherein the paperboard material comprises a laminate of a smooth cover sheet and an inner lining, whereby said parallel lines of perforations weaken a wide area of said inner lining to permit said inner lining to be easily broken.

* * * * *